US006807710B2

(12) United States Patent
Abbott et al.

(10) Patent No.: US 6,807,710 B2
(45) Date of Patent: Oct. 26, 2004

(54) HINGES

(75) Inventors: David M. Abbott, Leicestershire (GB); Michael James, Nottinghamshire (GB)

(73) Assignee: Bekaert Handling Limited, Spennymoor (GB)

( * ) Notice: Subject to any disclaimer, the term of this patent is extended or adjusted under 35 U.S.C. 154(b) by 50 days.

(21) Appl. No.: 10/410,000

(22) Filed: Apr. 9, 2003

(65) Prior Publication Data

US 2003/0200624 A1 Oct. 30, 2003

(30) Foreign Application Priority Data

Apr. 10, 2002 (GB) ..... 0208181

(51) Int. Cl.[7] ..... E05D 1/00

(52) U.S. Cl. ..... 16/221; 16/261; 256/68; 403/385

(58) Field of Search ..... 16/261, 264, 221, 16/270, 250–254; 248/74.1–74.4, 68.1; 403/362, 385, 177, 65, 64, 71, 110, 101; 256/65.01, 68, 69, 66; 24/459, 485, 489, 573.9, 581.12

(56) References Cited

U.S. PATENT DOCUMENTS 1,232,048 A * 7/1917 Kolkmeier ..... 16/253
1,261,678 A * 4/1918 Barnes et al. ..... 16/253
2,651,806 A * 9/1953 Thompson ..... 16/253
2,821,762 A * 2/1958 Foose ..... 24/459
3,268,946 A * 8/1966 Case ..... 16/253
4,408,924 A * 10/1983 Huebner ..... 403/23
5,593,143 A * 1/1997 Ferrarin ..... 256/68
D379,753 S * 6/1997 Honda ..... D8/323

FOREIGN PATENT DOCUMENTS

GB 0612904 A2 * 8/1994

* cited by examiner

*Primary Examiner*—Robert J. Sandy
*Assistant Examiner*—Andre' L. Jackson
(74) *Attorney, Agent, or Firm*—King & Schickli, PLLC

(57) ABSTRACT

A hinge (11) comprising a bobbin (12) and an arm (13), the bobbin having a peripheral flange (14) at each end of a cylindrical portion (15) and being formed with two parts (12A, 12B) split longitudinally with internal surfaces (16) enabling the bobbin to be assembled non-rotatably around a rectangular-section frame member (17), there being holes (18) in the bobbin parts for securing them to the rectangular-section frame member, and the arm (13) having a first bore (19) rotatable around the cylindrical portion (15) of the bobbin and a second bore (20) parallel to the first bore and in which a round-section frame member (21) can rotate, the arm being split between the two bores and beyond at least one of the bores in a plane containing the axes of the bores enabling the arm (13) to be assembled around the bobbin (12) and the round-section frame member (21), there being holes (22) in the arm (13) intermediate the bores (19, 20) and perpendicular to the plane for securing the arm on the bobbin and the round-section frame member

14 Claims, 5 Drawing Sheets

HINGES

This invention relates to hinges, more particularly—but not exclusively—to hinges for gates of materials handling containers, such as cage pallets, having a requirement for the gate (or gates) of a container to be able to swing from a container-closed position to an open position alongside the outside of a side wall.

In the case of a materials handling container having corner uprights formed from rectangular-section tube, most usually square-section, gate hinges each consisting of two bushes welded one to the round-section tubular frame of the gate and the other to an upright and connected by a hinge-pin need the bushes to project from the outside corner of the upright to enable the gate to meet the above requirement. Therefore, when in the closed position the gate lies to the outside of the corner upright.

It is the object of the present invention to provide a hinge construction for mounting on a rectangular-section frame member and connection to a round-section frame member enabling the latter to swing by up to 270° round the rectangular-section upright as well as swinging with respect to the hinge, thus enabling the gate (or gates) of a materials handling container to be able to swing from a container-closed position between corner uprights to an open position alongside the outside of a side wall.

According to the present invention, a hinge comprises a bobbin and an arm, the bobbin having a peripheral flange at each end of a cylindrical portion and being formed with two parts split longitudinally with internal surfaces enabling the bobbin to be assembled non-rotatably around a rectangular-section frame member, there being holes in the bobbin parts for securing them to the rectangular-section frame member (e.g. by bolts or blind rivets), and the arm having a first bore rotatable around the cylindrical portion of the bobbin and a second bore parallel to the first bore and in which a round-section frame member can rotate, the arm being split between the two bores and beyond at least one of the bores in a plane containing the axes of the bores enabling the arm to be assembled around the bobbin and the round-section frame member, there being holes in the arm intermediate the bores and perpendicular to the plane for securing the arm on the bobbin and the round-section frame member (e.g. by a bolt or rivet).

The parts of the bobbin may be identical or similar halves with male projections and female recesses for interengagement for positive location together before securing to a rectangular-section frame member (by bolting or rivetting), and may have further internal recesses, leaving spaced surfaces for abutting a rectangular-section frame member, to save both weight and quantity of material, especially when forming the bobbin of plastics; alternatively, the bobbin may comprise identical or similar halves hinged together using one side of the split.

The arm may be formed in two parts, again identical or similar halves, but conveniently, when formed of plastics, splitting between the bores and beyond only one of the bores (preferably the second bore for receiving a round-section frame member) enables the arm to be sprung open for fitting of the first bore around the bobbin and the second bore round a round-section frame member. The exterior of the arm may have recesses, leaving flanges between bore-forming portions, again to save both weight and quantity of material. A shroud may be provided to cover the exterior recesses, which shroud may be secured in place by a bolt or rivet used for securing the arm on the bobbin and the round-section frame member, and the shroud may be provided with stiffening ribs fitting within the exterior recesses in the arm.

The cylindrical portion of the bobbin may be equal in axial length to the first bore portion of the arm, or it may be of greater length to enable the arm to slide as well as rotate, e.g., as is often needed to enable a gate (or gates) of materials handling containers to be lifted clear of a locking formation.

The sides of the split between the two bores of the arm may be spaced apart to enable one end of a rigid bar to be clamped therebetween, the other end of the bar being available for similar clamping in the arm of a similar hinge, whereby the bar will ensure both arms swing together and in alignment. The peripheral flanges on the bobbin may be partially cut away to form stops for the bar to define limits for swinging of the arms.

Two embodiments of the invention will now be described, by way of example only, with reference to the accompanying drawings, in which.

Figure 5:
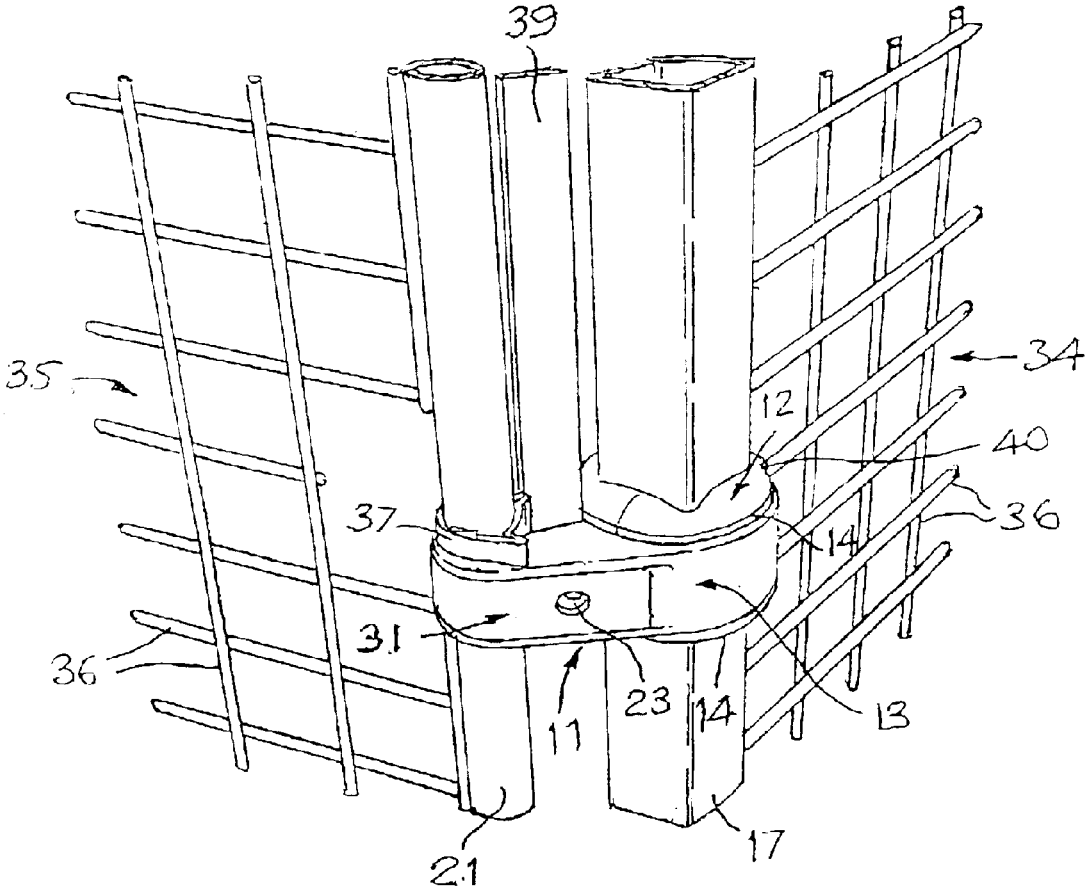
FIG. 5 is a fragmentary perspective view showing the first embodiment in use between a side wall and a gate of a materials handling cage or container, with the arm swung part way between limiting positions.
Figure 6:
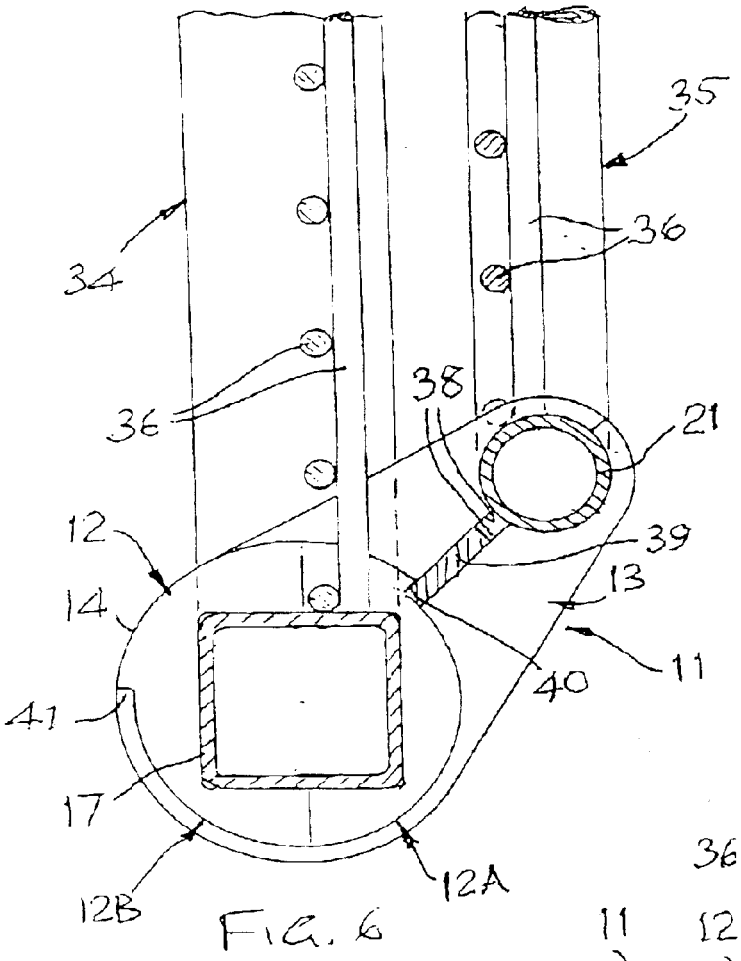
FIG. 6 is a fragmentary cross-section taken from above the hinge in FIG. 5 showing the hinge in one limiting position in which the gate of the cage is open and lies alongside the outside of the side wall.
Figure 7:
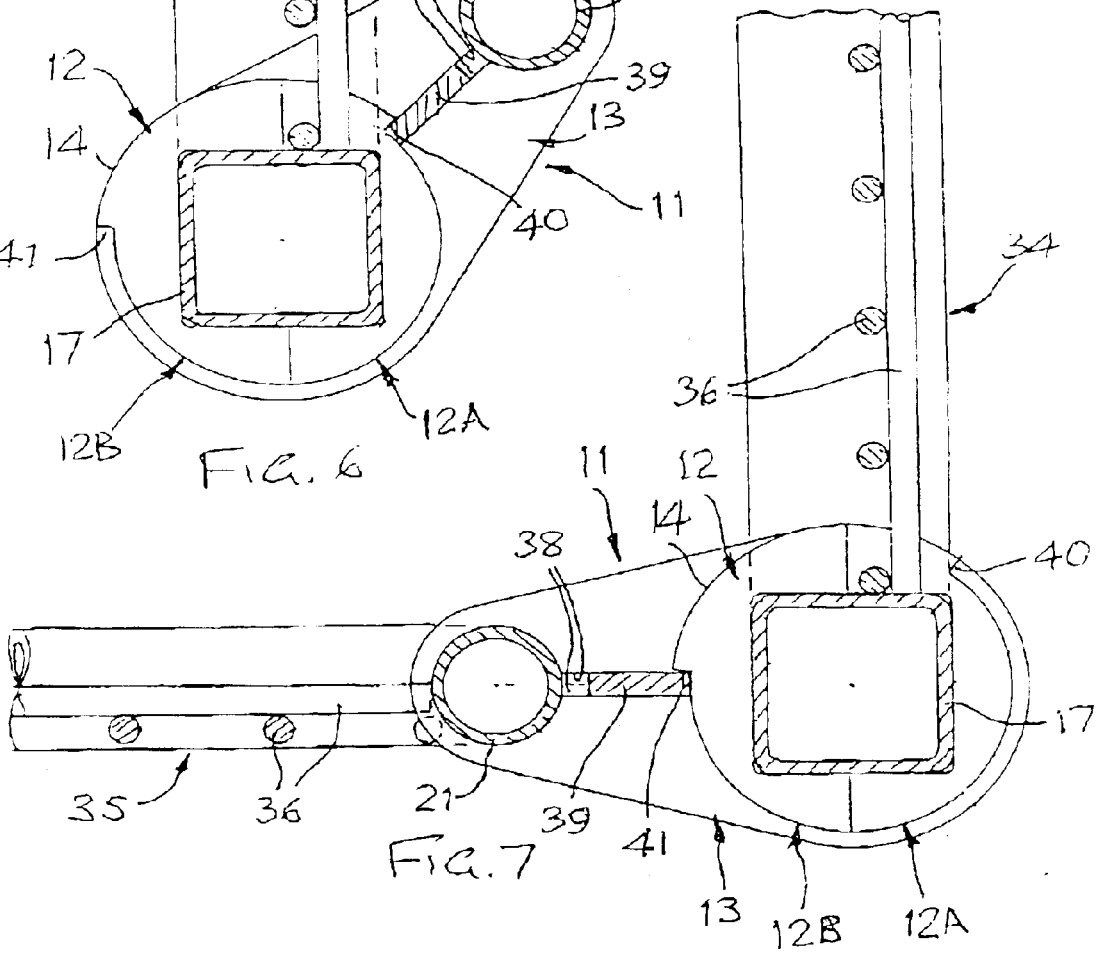
Figure 8:
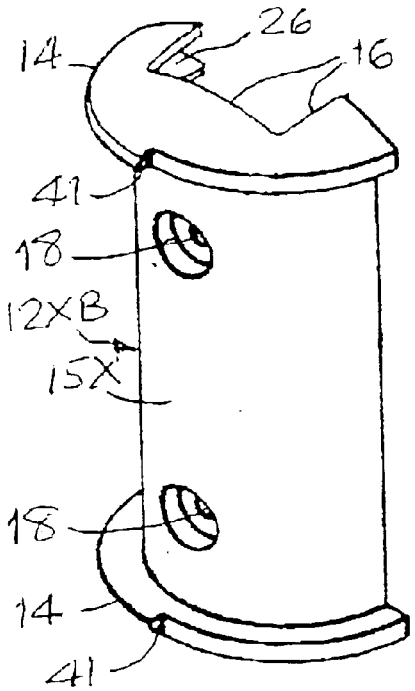
Figure 9:
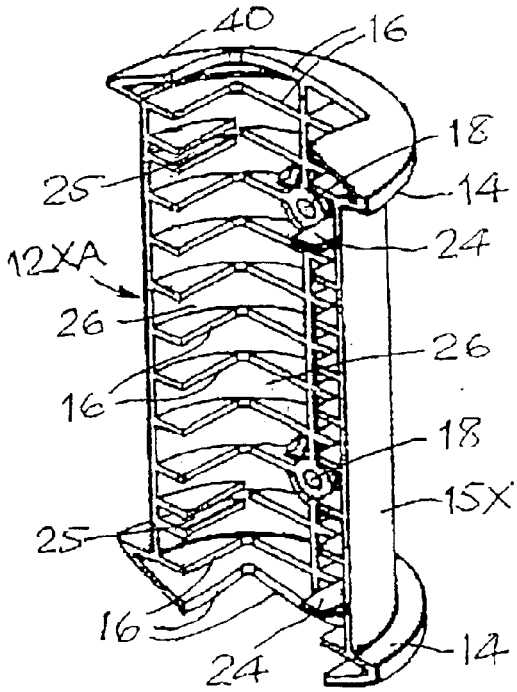
Figure 10:
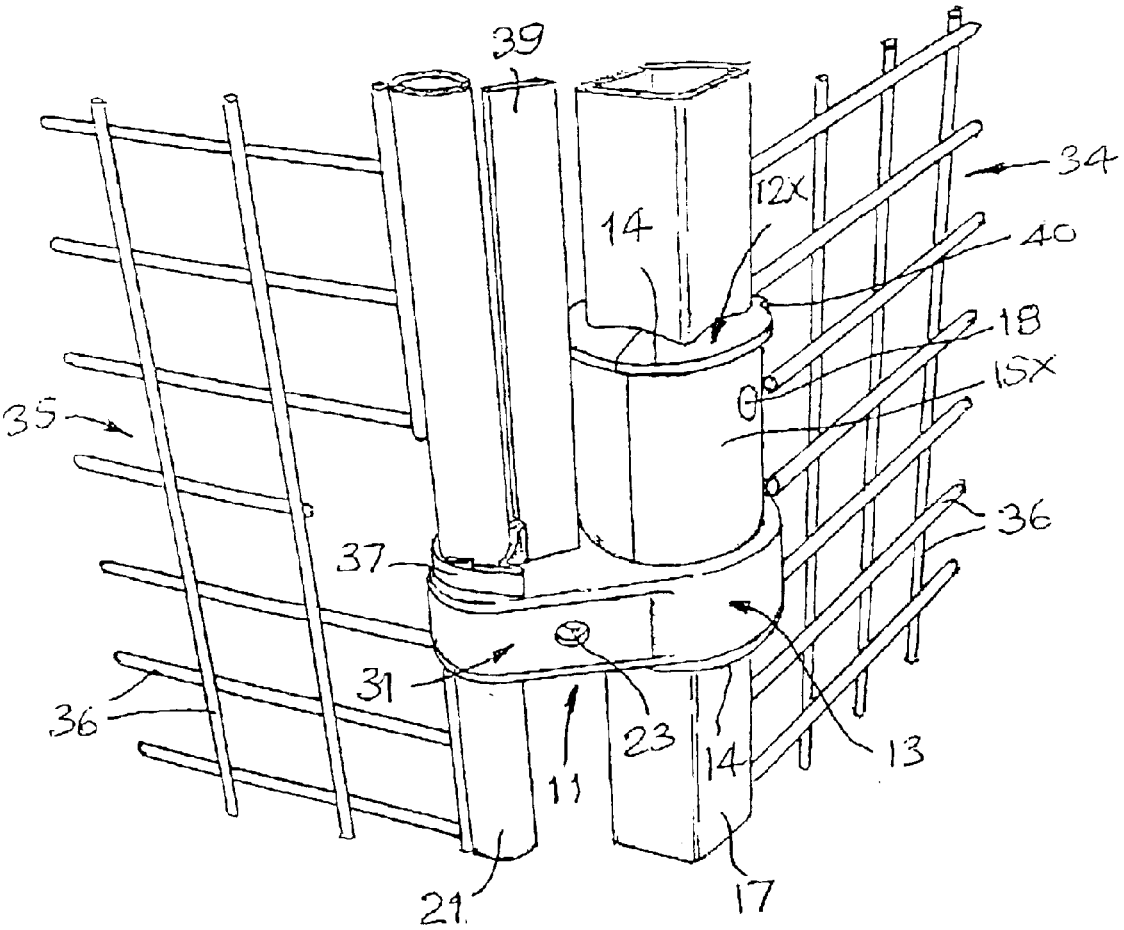

FIG. 7 corresponds to FIG. 6 but shows the hinge in the other limiting position in which the gate is in closed position;

FIGS. 8 and 9 are isometric views of the two halves of a bobbin for incorporation in the second embodiment; and FIG. 10 corresponds to FIG. 5 but shows the second embodiment in use between a side wall of a materials handling cage and a gate which has to be lifted before it can be swung between closed and open positions.

Figure 1:
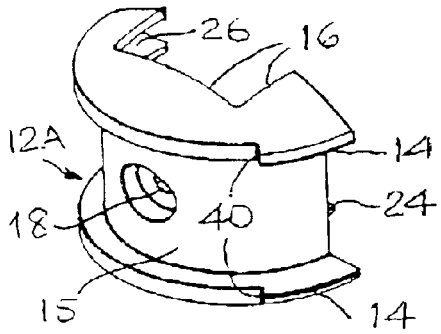
FIGS. 1 and 2 are isometric views of the two halves of a bobbin for incorporation in the first embodiment.
Figure 2:
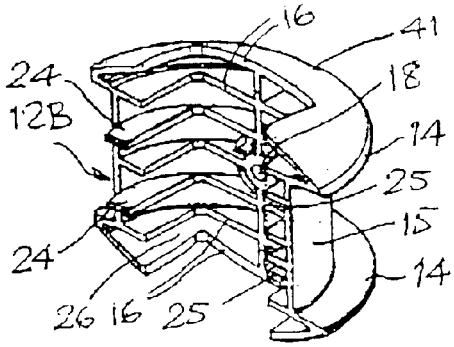

The First embodiment of hinge 11 (FIGS. 5 to 7) in accordance with the invention comprises a bobbin 12 and an arm 13, the bobbin having a peripheral flange 14 at each end of a cylindrical portion 15 and being formed with two parts 12A (FIG. 1) and 12B (FIG. 2) split longitudinally with internal surfaces 16 enabling the bobbin to be assembled non-rotatably around a rectangular-section frame member 17 (FIGS. 5 to 7), there being holes 18 in the bobbin parts 12A, 12B for securing them to the rectangular-section frame member (e.g. by bolts or blind rivets, not shown), and the arm 13 having a first bore 19 rotatable around the cylindrical portion 15 of the bobbin and a second bore 20 parallel to the first bore and in which a round-section frame member 21 (FIGS. 5 to 7) can rotate, the arm being split between the bores 19, 20 and beyond the bore 20 in a plane containing the axes of the bores enabling the arm to be assembled around the bobbin and the round-section frame member, there being holes 22 in the arm intermediate the bores and perpendicular to said plane for securing the arm on the bobbin and the round-section frame member (e.g. by a bolt 23 or rivet).

The parts 12A, 12B of the bobbin are similar halves with male projections 24 and female recesses 25 for interengagement for positive location together before securing to the rectangular-section frame member 17 (by bolting or rivetting), and have further internal recesses 26 leaving spaced surfaces 16 for abutting the rectangular-section frame member, to save both weight and quantity of material, especially when forming the bobbin of plastics.

Figure 4:
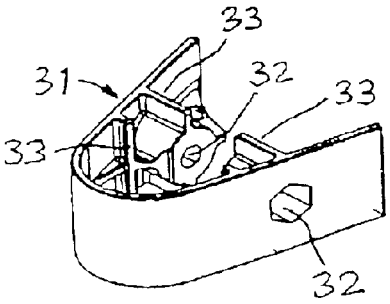
FIG. 4 is an isometric view of a shroud for use on the arm of FIG. 3.
Figure 3:
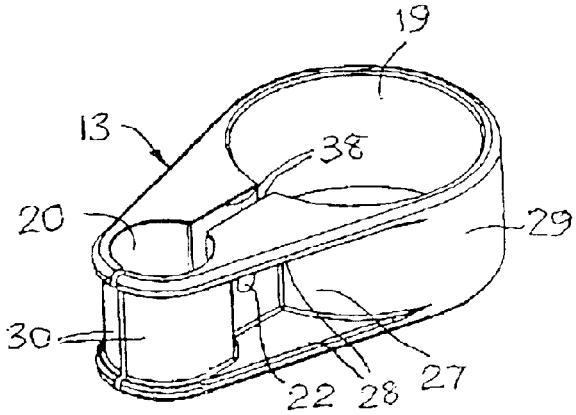
FIG. 3 is an isometric view of an arm for incorporation in either of the embodiments.

The exterior of the arm 13 has recesses 27 leaving flanges 28 between bore-forming portions 29, 30, again to save both weight and quantity of material. A shroud 31 (FIG. 4) is provided to cover the exterior recesses 27, which shroud has holes 32 secured in place by the bolt 23 (or rivet) used for securing the arm 13 on the bobbin 12 and the round-section frame member 21, and the shroud is provided with stiffening ribs 33 fitting within the exterior recesses 26 in the arm.

In FIGS. 5 to 7 the rectangular-section frame member 17 is part of a side wall 34 of a materials handling cage and the round-section frame member 21 is part of a gate 35 of the cage, wire mesh 36 of each being cut away to accommodate the parts of the hinge 11. The cylindrical portion 15 of the bobbin 12 is equal in axial length to the first bore portion 19, 29 of the arm 13 so no relative axial movement is possible, but because the round-section frame member 21 is free to rotate in the bore 20 it is secured against relative axial movement by a staking clip 37.

The sides 38 of the split between the two bores 19, 20 of the arm 13 are spaced apart to enable one end of a rigid bar 39 to be clamped therebetween, the other end of the bar being available for similar clamping in the arm of a similar upper hinge (not shown), whereby the bar will ensure both arms swing together and in alignment. The peripheral flanges 14 on the bobbin 12 are partially cut away to form stops 40, 41 for the said bar to define limits for swinging of the arms, stop 40 for the gate open position shown in FIG. 6 and stop 41 for the gate closed position shown in FIG. 7.

In FIGS. 8 to 10 the cylindrical portion 15X of the bobbin 12X is of greater length than the first bore portion 19, 29 of the arm 13 to enable the arm to slide as well as rotate (the bobbin 12X otherwise being similar to the bobbin 12 of FIGS. 1, 2 and 5, and like reference numerals representing like parts) to enable the gate 35 to be lifted clear of a locking formation, not shown. The bar 39 will be effective for raising the arm of a similar upper hinge having a similarly elongated bobbin, as well as ensuring both arms swing together and in alignment.

We claim:

1. A hinge comprising a bobbin and an arm, the bobbin having a peripheral flange at each end of a cylindrical portion and being formed with two parts split longitudinally with internal surfaces enabling the bobbin to be assembled non-rotatably around a rectangular-section frame member, there being holes in the bobbin parts for securing them to the rectangular-section frame member, and the arm having a first bore rotatable around the cylindrical portion of the bobbin and a second bore parallel to the first bore and in which a round-section frame member can rotate, the arm being split between the two bores and beyond at least one of the bores in a plane containing the axes of the bores enabling the arm to be assembled around the bobbin and the round-section frame member, there being holes in the arm intermediate the bores and perpendicular to the plane for securing the arm on the bobbin and the round-section frame member.

2. A hinge as in claim 1, wherein the cylindrical portion of the bobbin is equal in axial length to the first bore portion of the arm.

3. A hinge as in claim 1, wherein the cylindrical portion of the bobbin is of greater axial length than the first bore portion of the arm, to enable the arm to slide as well as rotate.

4. A hinge as in claim 1, wherein the sides of the split between the two bores of the arm are spaced apart to enable one end of a rigid bar to be clamped therebetween, the other end of the bar being available for similar clamping in the arm of a similar hinge, whereby the bar will ensure both arms swing together and in alignment.

5. A hinge as in claim 4, wherein the peripheral flanges on the bobbin are partially cut away to form stops for the bar to define limits for swinging of the arms.

6. A hinge as in claim 1, wherein the parts of the bobbin are identical or similar halves with male projections and female recesses for interengagement for positive location together before securing to a rectangular-section frame member.

7. A hinge as in claim 6, wherein the parts of the bobbin have further internal recesses, leaving spaced surfaces for abutting a rectangular-section frame member.

8. A hinge as in claim 7, wherein the bobbin is formed of plastics.

9. A hinge as in claim 1, wherein the arm is formed of plastics and is split between the bores and beyond only one of the bores, to enable the arm to be sprung open for fitting of the first bore around the bobbin and the second bore around a round-section frame member.

10. A hinge as in claim 9, wherein the arm is split between the bores and beyond only the second bore for receiving a round-section frame member.

11. A hinge as in claim 1, wherein the exterior of the arm has recesses, leaving flanges between bore-forming portions.

12. A hinge as in claim 11, wherein a shroud is provided to cover the exterior recesses in the arm.

13. A hinge as in claim 12, wherein the shroud is secured in place by a bolt or rivet used for securing the arm on the bobbin and the round-section frame member.

14. A hinge as in claim 11 or claim 12, wherein the shroud is provided with stiffening ribs fitting within the exterior recesses in the arm.

* * * * *